US005456430A

United States Patent [19]

Ortiz-Rivas

[11] Patent Number: 5,456,430

[45] Date of Patent: Oct. 10, 1995

[54] FROG WITH INTERCHANGEABLE INSERT

[76] Inventor: Arturo A. Ortiz-Rivas, Manuel Ma De Llano, No. 1104-D Ote, Monterrey, N.L., Mexico

[21] Appl. No.: 237,589

[22] Filed: May 3, 1994

[30] Foreign Application Priority Data

May 4, 1993 [MX] Mexico ..... 22807

[51] Int. Cl.[6] ..... E01B 7/00

[52] U.S. Cl. ..... 246/468; 246/460; 246/472

[58] Field of Search ..... 246/454, 458, 246/460, 461, 462, 463, 465, 468, 469, 470, 472

[56] References Cited

U.S. PATENT DOCUMENTS

| | | | |
|---|---|---|---|
| 170,537 | 11/1875 | Elliot | 246/458 |
| 696,837 | 4/1902 | McTighe | 246/454 |
| 869,695 | 10/1907 | Donahoe | 246/460 |
| 881,984 | 3/1908 | Weaver et al. | 246/472 |
| 885,298 | 4/1908 | Rost | 246/463 |
| 887,847 | 5/1908 | Reinoehl et al. | 246/460 |
| 889,199 | 6/1908 | Canty | 246/460 |
| 1,765,856 | 6/1930 | Werthmann | 246/460 |

OTHER PUBLICATIONS

Railway Track & Structures, Sep. 1991, pp. 35–38.

American Railway Engineering Association, Plan No. 300–79, 1979.

American Railway Engineering Association, Plan No. 320–59, 1959.

American Railway Engineering Association, Plan No. 490–82, 1982.

American Railway Engineering Association, Plan No. 600–80, 1979.

American Railway Engineering Association, Plan No. 600–A–79, 1979.

American Railway Engineering Association, Plan No. 616–89, 1982.

American Railway Engineering Association, Plan No. 621–89, 1986.

American Railway Engineering Association, Plan No. 641–82, 1982.

American Railway Engineering Association, Plan No. 671–82, 1982.

*Primary Examiner*—Mark T. Le

*Attorney, Agent, or Firm*—Pravel, Hewitt, Kimball & Krieger

[57] ABSTRACT

An improved frog is provided with an interchangeable insert for a railroad turnout, such as a frog or crossing. The frog has a new modular interchangeable insert, which permits easy changing of worn pieces in situ.

The insert is a solid, unitary piece of high strength steel of two different geometrical shapes. An upper part of the insert is triangular in shape having a flat or planar base surface. A lower part of the insert is of a rectangular, planar sided member of box shape and serves as the web, running from the front to rear of and through the center and beneath the triangular upper part.

10 Claims, 5 Drawing Sheets

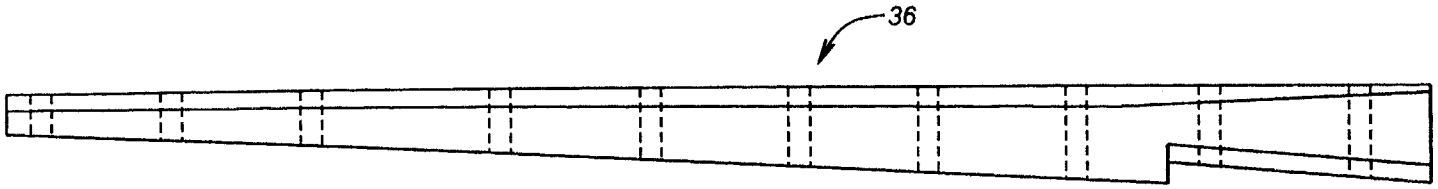
FIG. 8
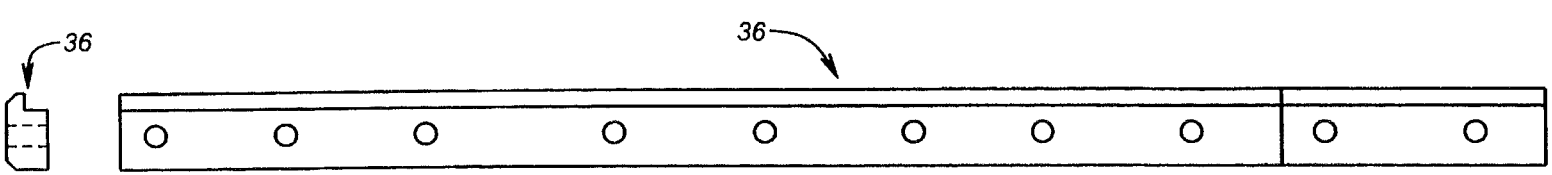
FIG. 7
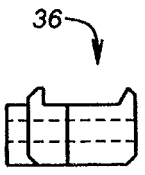
FIG. 9
FIG. 6

FROG WITH INTERCHANGEABLE INSERT

CROSS-REFERENCE TO RELATED APPLICATION

The present application and applicant's co-pending U.S. patent application Ser. No. 08/237,616, "IMPROVED RAILROAD TURNOUT FROG WITH CONTINUOUS RUNNING SURFACE," filed of even date with the present application, and now issued as U.S. Pat. No. 5,393,019 both related to frogs for railroad turnouts.

BACKGROUND OF THE INVENTION

1. Field of Invention

The present invention relates to frogs for turnouts or crossings of railroad tracks.

2. Description of Prior Art

So far as is known, presently used frogs for railroad usage, particularly those for heavy traffic lines, are formed in their entirety as single pieces from manganese steel; another type are the rail-bound, manganese steel frogs which are a combination of the solid and bolted frogs. Once the frogs became worn from service usage or when they are broken, the complete frog is usually discarded as salvage or scrap material. The only available repair or maintenance possibility is electric welding, but this is a cumbersome, expensive and time consuming process.

SUMMARY OF INVENTION

Briefly, the present invention provides a new and improved railroad frog for a railroad turnout in which first and second wings converge toward each other to form the juncture with first and second point rails. The improved railroad frog includes a heel filler block member mounted between the first and second point rails to form a connection between them. First and second wing filler members are mounted extending forwardly from an end of the wing rails on parallel sides from the heel filler block. The wing filler members form a connection between the point rails and the wings.

The first and second wing filler members also are formed having a gap between them along their forward extent and having a flat upper surface formed thereon adjacent the gap. An interchangeable insert is provided having a central bar insertable in the gap between said first and second wing filler members. The interchangeable insert is mountable on the flat upper surfaces of the wing filler members.

The interchangeable insert is both the most important structural part of the frog and also the part of the frog most susceptible to wear. According to the present invention, the insert is made to be a replaceable insert and is made to be equal geometrically to the frog's angle between the wings and the point rails.

With the present invention, maintenance or replacement of a worn frog component is made easier and more economical. Further, the interchangeable inserts can be mass produced. Consequently, lower equipment production costs can be achieved.

This makes possible changing or replacement of worn frog components in situ. This in turn permits efficient use of all components, changing only the insert part when it becomes worn while permitting retention and continued use of other less worn parts. With the frog of the present invention, it is also possible to accurately fabricate the frog components.

BRIEF DESCRIPTION OF THE DRAWINGS

The characteristic details of the present invention are clearly shown in the following description and accompanying figures which illustrate this and provide points of reference to indicate the same parts in the figures shown.

FIG. 6 is a front view plan of a left wing filler component of the frog of FIG. 1.

FIG. 7 is an elevation view of a left wing filler component of the frog of FIG. 1.

FIG. 8 is a top view of the left wing filler of FIG. 7.

FIG. 9 is a rear view of the left wing filler of FIG. 7.

DESCRIPTION OF PREFERRED EMBODIMENT

Figure 1:
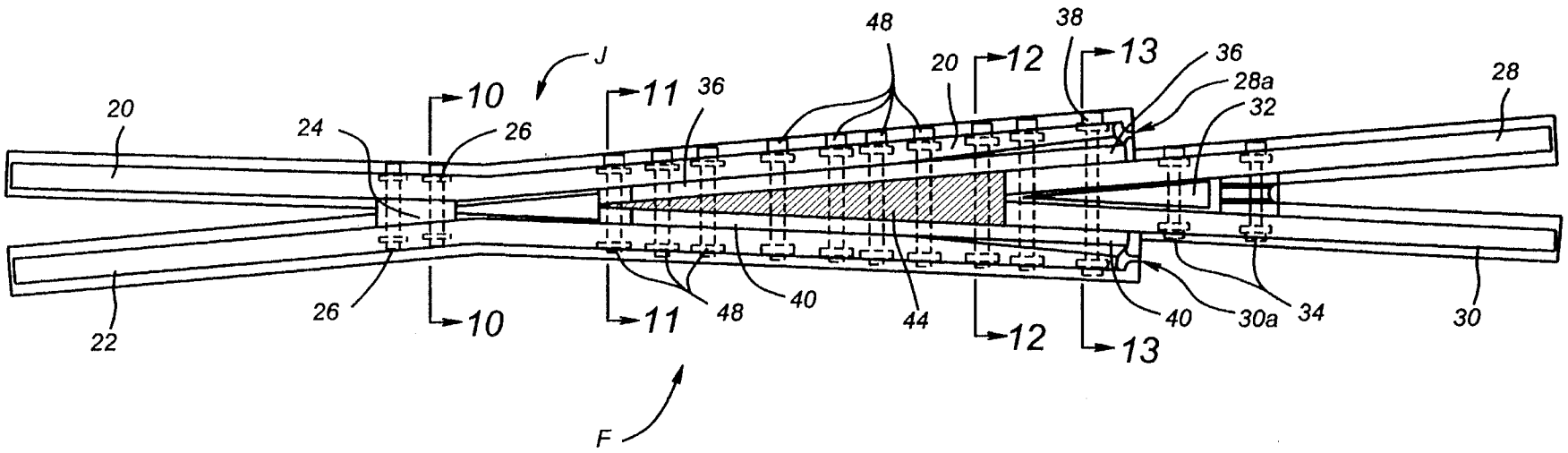
FIG. 1 is a plan view of a modular frog with an improved interchangeable insert for track turnouts according to the present invention.
Figure 5:
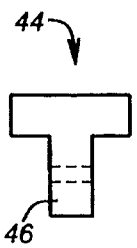
FIG. 5 is a rear view of the improved interchangeable insert of FIG. 3.
Figure 3:
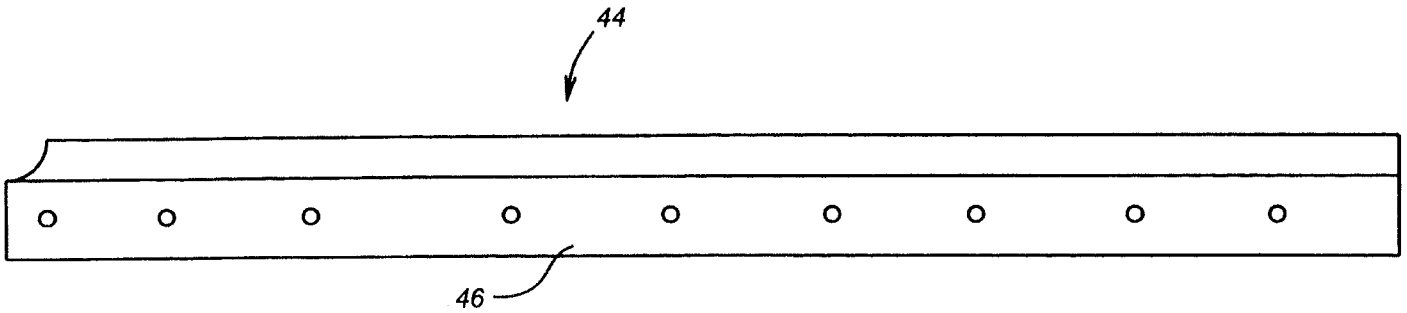
FIG. 3 is an elevation view of an improved interchangeable insert component of the frog of FIG. 1.
Figure 4:
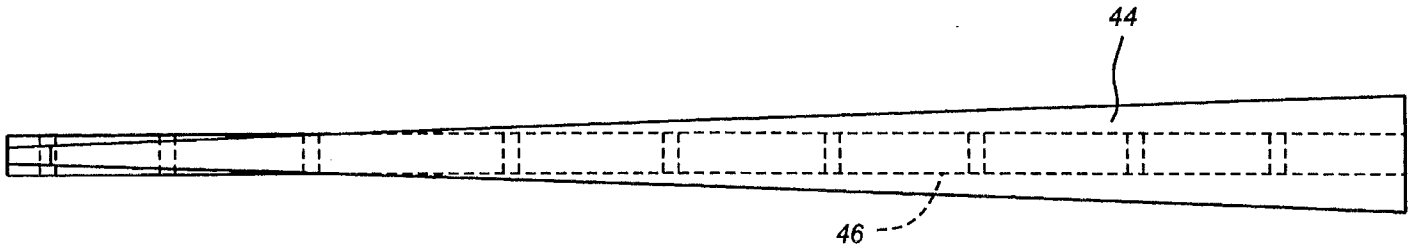
FIG. 4 is a top view of the improved interchangeable insert of FIG. 3.
Figure 10:
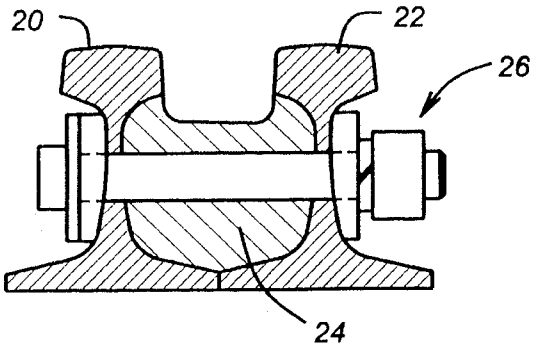
FIG. 10 is a cross-sectional view taken along the lines 10—10 of FIG. 1.

In accordance with the drawings a new and improved modular standard frog F with improved interchangeable insert (FIG. 1) for a turnout, such as a frog or crossing railroad track, is shown. The frog is formed by assembling a left or first rail wing 20 and a right or second rail wing 22. The wings 20 and 22 are connected by means of a conventional throat block 24 (FIGS. 1 and 10), all three of such components being fastened to each other with bolts 26. The frog F is located in a railroad turnout J where the first wing 20 and the second wing 22 converge toward each other to form a juncture with a first point rail 28 and a second point rail 30. The railroad frog F according to the present invention includes a heel filler block member 32 (FIGS. 1 and 14–17) mounted between the first and second point rails 28 and 30. A connection is formed by bolts 34 (FIG. 1) between the heel filler block 32 and the point rails 28 and 30.

A first wing filler member 36 (FIGS. 1 and 6–9) is mounted extending forwardly from the end 28*a* of the first wing rail 20 and parallel to the heel filler block 32. The first wing filler member 36 serves to form a connection between the first point rail 28 and said first wing 20. Fastener bolts 38 are inserted through the wing 20, the wing filler member 36 and the point rail 28 to connect these structural members to each other and to other structure, as will be set forth below.

Figure 12:
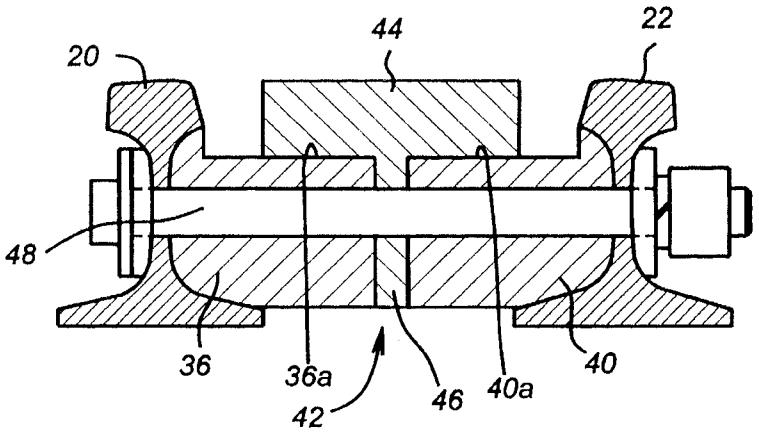
FIG. 12 is a cross-sectional view taken along the lines 12—12 of FIG. 1.
Figure 13:
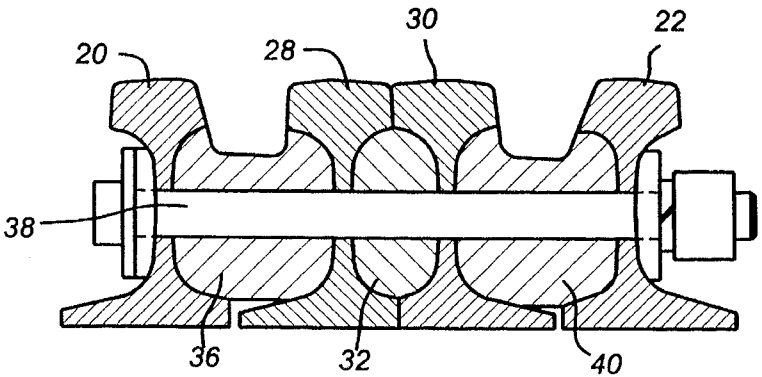
FIG. 13 is a cross-sectional view taken along the lines 13—13 of FIG. 1.

A second wing filler member 40 is mounted extending forwardly from the end 30*a* of the second wing rail 22 and parallel to the heel filler block 32. The second wing filler member 40 is of like construction to first wing filler member 38 shown in FIGS. 6–9, except that the location of the structural features (FIG. 12) thereon is reversed. The second wing filler member 40 serves to form a connection between the second point rail 30 and the second wing 22. The fastener bolts 38 also pass (FIG. 13) through the heel filler block 32, the point rail 30, the second wing filler member 40 and the wing 22 for interconnection purposes.

A longitudinally extending gap 42 (FIG. 12) is formed between the first and second wing filler members 36 and 40 along their forward extent. Further, a flat upper surface 36*a* and 40*a* is formed on each of filler members 36 and 40, respectively, adjacent the gap 42.

An interchangeable insert 44 having a central bar 46 insertable in the gap 42 is mounted between the first and second wing filler members 36 and 40. When in proper position, the insert 44 is mounted to rest on the flat upper surfaces 36*a* and 40*a*. A suitable number of fasteners or bolts 48 are inserted through aligned openings in the wing 20, wing filler member 36, bar 46 of insert 40, wing filler member 40 and the wing 22 to connect these structural members together.

Figure 2:
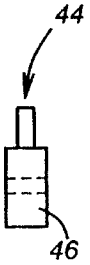
FIG. 2 is a front view of the improved interchangeable insert of FIG. 1.
Figure 11:
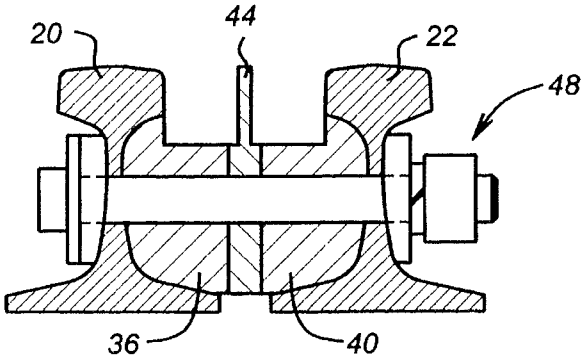
FIG. 11 is a cross-sectional view taken along the lines 11—11 of FIG. 1.
Figure 16:
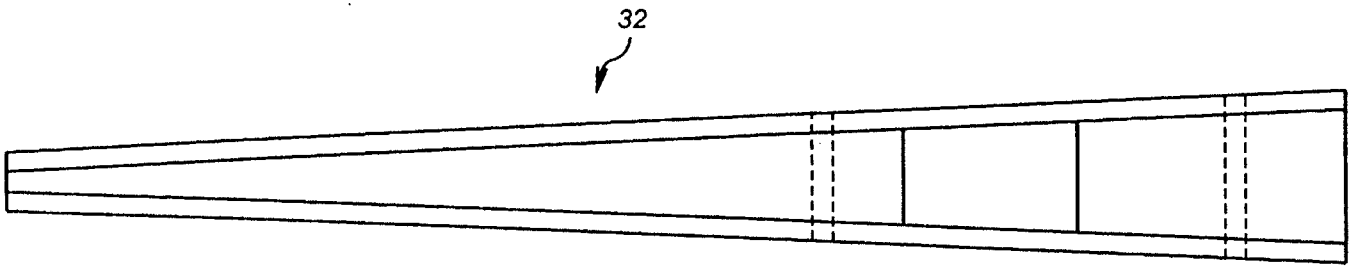
FIG. 16 is a top view of the point rails heel fill block of FIG. 14.
Figure 15:
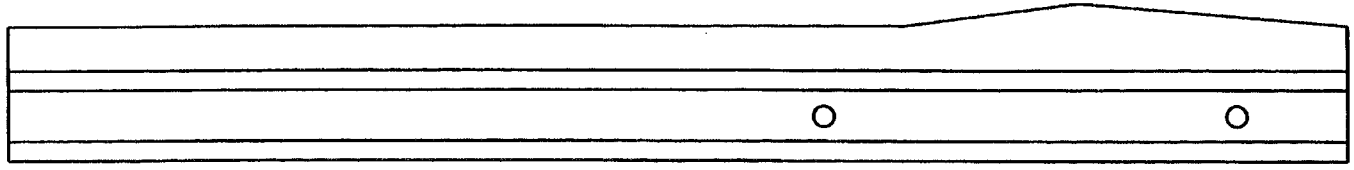
FIG. 15 is an elevation view of the point rails heel filler block of FIG. 14.
Figure 17:
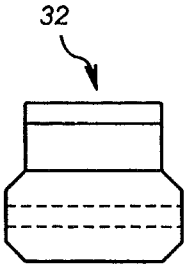
FIG. 17 is a rear view of the point rails heel filler block of FIG. 14.
Figure 14:
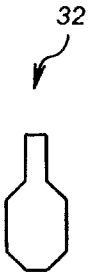
FIG. 14 is a front view of a point rails heel filler block component of the frog of FIG. 1.

When the frog F is assembled, the interchangeable insert 44 is placed (FIGS. 11 and 12) supported on each side by the wing fillers 36 and 40 (FIG. 8) and fastened to the wings 20 and 22 (FIGS. 1 and 2) by means of bolts 48. The wing fillers 36 and 40, as disclosed above, have flat upper surface portions 36*a* and 40*a*, parts which serve the base and support of the insert 44. Assembly of the modular standard frog F with improved interchangeable insert 44 may then be completed. To do this, the left or first points 28 and right or second points 30 are assembled with the point rails heel filler block 36 to the wings 20 and 22 and fastened together by means of bolts 34.

In this manner, a modular standard frog F is formed with improved interchangeable insert 44 for the track turnout. Features of a frog according to the present invention include the following:

Due to the design of its components, the frog F according to the present invention allows change of worn parts, particularly the insert 44, for new ones, keeping in the same places those parts which are less worn and still useful.

When the rolling stock passes over the frogs and produces wear on the contact pieces, the insert is at that particular worn spot. When the insert becomes broken or worn, it can be changed for a new one in situ. This can be done without throwing away the complete frog as is up to now done.

The other frogs must be thrown away as a complete unit when their rolling stock contact area becomes worn and useless. Maintenance and repair work on the frogs can thus be made in place easily and quickly.

The design of the modular standard frog with improved insert can also be performed in crossings and other similar devices with the same principles.

The present invention thus provides an improved frog with interchangeable insert 44 for the turnouts in the railroad track which has an insert, preferably made of manganese steel, which it is possible to easily change in situ without throwing away the whole frog. Further, only the insert 44 need be made from a manganese or higher strength steel; the other components can be made from less expensive, conventional rail steel.

This disadvantage of previous efforts is eliminated by means of a frog according to the present invention having an improved interchangeable insert. Features of this frog in addition to include the modular design of the frog, which permits changing of parts that work with the rolling stock, such as the wings, points and insert when they become worn. In this manner, parts without any wear due to the absence of contact with the rolling stock, such as filler members and bolts, may be made from conventional steel rather than manganese steel and kept in place. This saves time and money. Additionally, replacements of worn parts can be made in situ easily and quickly.

Having described the invention above, various modifications of the techniques, procedures, material and equipment will be apparent to those in the art. It is intended that all such variations within the scope and spirit of the appended claims be embraced thereby.

I claim:

1. In a railroad flog where first and second wing rails converge toward each other to form a juncture with first and second point rails, an improved railroad frog comprising:

a heel filler block member mounted between the first and second point rails and forming a connection between them;

a first wing filler member mounted extending forwardly from the end of said first wing ratio; and parallel 19 a side of said heel filler block, said first wing filler member forming a connection between said first point rail and said first wing rail;

a second wing filler member mounted extending forwardly from the end of said second wing rail and parallel to a side of said heel filler block, said second wing filler member forming a connection between said second point rail and said second wing rail;

said first and second wing filler members forming a central, vertically extending gap between them along their forward extent and having a flat upper surface formed on each of them adjacent said gap; and an interchangeable insert having a triangular upper body member which serves as a contact for the rolling stock, and further including a flat lower surface formed thereon;

said insert further having a central bar extending, vertically downwardly from said lower surface of said upper body member;

said central bar having uniform horizontal thickness and having a lower surface forming a bottom surface of the interchangeable insert;

said central bar being inserted in said gap formed between said first and second wing filler members; and said lower surface of said upper body member being mounted on said flat upper surfaces formed on said first and second wing filler members.

2. The structure of claim 1, wherein said railroad frog is a rail turnout component.

3. The structure of claim 1, wherein said railroad frog is a rail crossing component.

4. The structure of claim 1, wherein said insert is formed of a higher strength steel than said first and second wing filler members.

5. The structure of claim 4, wherein said insert is formed from manganese steel.

6. The structure of claim 1, wherein:

each of said first and second wing filler member thus connector passages formed therethrough;

said interchangeable insert has connector passages formed through said central bar portion thereof; and said first and second wing rails have connector passages formed therethrough.

7. The structure of claim 6, further including:

means inserted through said connector passages in said first and second wing filler members, said central bar of said interchangeable insert and said first and second wing rails for connecting them together.

8. The structure of claim 1, wherein:

said heel filler block member has connector passages formed through it;

said first and second point rails have connectors passages formed therethrough; and each of said first and second wing filler members has connector passages formed therethrough.

9. The structure of claim 8, further including:

means inserted through said connector passages in said heel filler block member, said first and second point rails and said first and second wing filler members for connecting them together.

10. In a railroad flog where first and second wings converge toward each other to form a juncture with first and second point rails, and having a heel filler block member mounted along two sides between the first and second point rails and forming a connection between them, a first wing filler member mounted extending forwardly from the end of said first wing rail and parallel to one of said sides of said heel filler block, said first wing filler member forming a connection between said first point rail and said first wing rail, a second wing filler member mounted extending forwardly from the end of said second wing rail and parallel to another of said sides of said heel filler block, said second wing filler member forming a connection between said second point rail and said second wing rail, the improvement comprising:

said first and second wing filler members forming a central, vertically extending gap between them along their forward extent and having a flat upper surface formed on each of them adjacent said gap; and an interchangeable insert having a triangular upper body member which serves as a contact for the rolling stock, and further including a flat lower surface formed thereon;

said insert further having a central bar extending vertically downwardly along planar side surfaces from said lower surface of said upper body member;

said central bar having uniform horizontal thickness and having a lower surface forming a bottom surface of the interchangeable insert;

said central bar being inserted in said gap formed between said first and second wing filler members; and said lower surface of said upper body member being mounted on said flat upper surfaces formed on said first and second wing filler members.

* * * * *